US007515840B2

(12) United States Patent
Yamane

(10) Patent No.: US 7,515,840 B2
(45) Date of Patent: Apr. 7, 2009

(54) IMAGE FORMING APPARATUS INCLUDING A COUNTING SECTION FOR COUNTING THE TONER IMAGE

(75) Inventor: Tsutomu Yamane, Tokyo (JP)

(73) Assignee: Oki Data Corporation, Tokyo (JP)

( * ) Notice: Subject to any disclaimer, the term of this patent is extended or adjusted under 35 U.S.C. 154(b) by 206 days.

(21) Appl. No.: 11/370,313

(22) Filed: Mar. 8, 2006

(65) Prior Publication Data

US 2006/0204258 A1 Sep. 14, 2006

(30) Foreign Application Priority Data

Mar. 11, 2005 (JP) ..... 2005-069354

(51) Int. Cl.
*G03G 15/00* (2006.01)

(52) U.S. Cl. ..... 399/44; 399/55

(58) Field of Classification Search ..... 399/38, 399/42, 43, 44, 53, 55
See application file for complete search history.

(56) References Cited

U.S. PATENT DOCUMENTS 6,871,026 B2 * 3/2005 Shimura et al. ..... 399/12
7,068,957 B2 * 6/2006 Shimura et al. ..... 399/49

FOREIGN PATENT DOCUMENTS

JP 5-210279 * 8/1993
JP 2002-365890 A 12/2002

* cited by examiner

*Primary Examiner*—Hoan H Tran
(74) *Attorney, Agent, or Firm*—Panitch Schwarze Belisario & Nadel LLP

(57) ABSTRACT

An image forming apparatus in which a toner layer is formed onto a developing roller which is restricted by a toner restricting member and rotated, toner is supplied to a photosensitive drum by the toner layer, and a toner image is formed onto the drum and transferred onto a print medium, thereby forming an image. The apparatus has: a counter which counts the toner image, on a dot unit basis, formed on the drum and a control unit which stops the rotation of the developing roller for a predetermined time and intermittently executes a series of image forming operation when a count value is equal to or larger than a predetermined reference value. The occurrence of filming is prevented by preventing an increase in toner temperature.

18 Claims, 7 Drawing Sheets

IMAGE FORMING APPARATUS INCLUDING A COUNTING SECTION FOR COUNTING THE TONER IMAGE

BACKGROUND OF THE INVENTION

1. Field of the Invention

The invention relates to an image forming apparatus of an electrophotographic system.

2. Related Background Art

An image forming apparatus of an electrophotographic system in which an electrostatic latent image is formed by exposing the surface of a photosensitive drum, the electrostatic latent image is developed, toner (developing material) is supplied onto the photosensitive drum through a developing roller, and a toner image is formed has been disclosed in JP-A-2002-365890.

According to the image forming apparatus of JP-A-2002-365890, when an image ratio called a print duty is high, in order to avoid a white-on-black phenomenon of an image which is caused by a lack of supply amount of the toner, a rotational speed of a developing material agitation conveying member to convey the toner to the developing roller while agitating it is raised in accordance with the print duty, thereby increasing the supply amount of the toner and preventing the occurrence of the white-on-black phenomenon of the image.

According to the above conventional image forming apparatus, the toner which is supplied by the developing material agitation conveying member is formed in a layer shape on the developing roller and the toner is supplied to the photosensitive drum through the developing roller. At this time, by making the toner-deposited developing roller come into pressure contact with a toner restricting member while rotating such a developing roller, it is restricted so that the toner of a thickness over a predetermined thickness dimension is not deposited onto the developing roller, and the toner layer of the desired thickness dimension is formed.

However, in the above conventional image forming apparatus in which the toner restricting member is come into pressure contact with the developing roller and the toner amount is restricted, there occurs inconvenience called filming in which, although the amount of toner which is supplied to the developing roller is sufficient, in the case of forming an image of a high print duty, the toner is fixed onto the toner restricting member of the portion corresponding to a region where such an image is formed.

The present inventors have vigorously examined causes of occurrence of the filming and considered as follows.

That is, when the image of the high print duty is formed, the toner on the developing roller has the heat, the toner is melt-bonded onto the toner restricting member by the heat, and the filming occurs. Thus, on the developing roller with which the toner restricting member is come into contact, in the peripheral portion in which the toner has been melt-bonded, a toner layer which is influenced by such toner and is thinner than the predetermined thickness dimension is formed. The inventors considered that in the toner image which is formed by supplying the toner from such a toner layer, since a desired toner amount is not supplied from the toner layer, a concentration is partially uneven in the print result.

The inventors considered that the reasons why the toner has the heat are as follows.

Although the toner is supplied from the toner layer to the photosensitive drum in accordance with the image to be formed, all of the toner of the layer thickness is not supplied in the supplying portion of the toner layer according to the image. That is, in the supplying portion of the toner layer, only the toner in the upper layer portion is supplied and the toner in the lower layer portion is not supplied but remains. Thus, a difference occurs between the thickness dimension in the toner layer after the toner supply in the portion where the toner supply amount is large and that in the portion where the toner supply amount is small.

In the case where the print duty is high or in the continuous printing, on the other hand, since the toner image is repetitively formed on the photosensitive drum, the reproduction of the toner layer for supplying the toner to the photosensitive drum is repeated.

As mentioned above, the toner is supplied to the developing roller having the toner layer of the uneven thickness dimensions after completion of the toner supply and the toner is restricted by the toner restricting member, thereby reproducing the toner layer. At this time, in the portion of the low thickness dimension in the toner layer, since the number of toner particles is small, each toner particle per unit in such a portion receives a large amount of energy generated by the depression of the toner restricting member. Thus, the inventors considered that the toner particles which received the large amount of energy vibrate among the toner particles and the toner has the heat by frictional heat caused by friction due to the vibration. The inventors, therefore, considered that an increase in toner temperature can be prevented by dispersing the energy which the toner particles per unit receive.

SUMMARY OF THE INVENTION

In consideration of the foregoing problem, it is an object of the invention to provide an image forming apparatus which can prevent an increase in toner temperature and can prevent the occurrence of filming.

The present invention provided an image forming apparatus in which a toner layer is formed onto a developing roller which is restricted by a toner restricting member and rotated, toner is supplied to an image holding body by the toner layer, a toner image is formed onto the image holding body, the toner image is transferred onto a print medium, and an image is formed. The image forming apparatus comprises a counting section which counts the toner image, on a dot unit basis, which is formed on the image holding body; and a control section which restricts the rotation of the developing roller when a count value of the counting section is equal to or larger than a predetermined reference value.

Moreover, In the image forming, the counting section counts the toner image, on a dot unit basis, which is formed in each of sections obtained by dividing the image at predetermined intervals in a main scanning direction on the image holding body; and when a count value is equal to or larger than a predetermined reference value in one of the sections, the control section executes intermittent control.

Moreover, in the image forming apparatus, the image holding body is a photosensitive drum; the apparatus has rotating number counting section which counts the number of rotating times of the photosensitive drum when the count value is equal to or larger than the predetermined reference value; and the control section executes intermittent control when a rotation count value exceeds a predetermined rotation reference value.

Moreover, the image forming apparatus may further comprises either temperature measuring section or moisture measuring section; and a correcting section which corrects the reference value on the basis of information from the measuring section.

Moreover, the image forming apparatus may further comprise either temperature measuring section or moisture measuring section; and a correcting section which corrects the rotation reference value on the basis of information from the measuring section.

Moreover, the image forming apparatus may further comprise either temperature measuring section or moisture measuring section, and wherein the control section changes an intermittent time in the intermittent control on the basis of information from the measuring section.

Furthermore, the present invention provided an image forming apparatus in which a toner layer is formed onto a developing roller which is restricted by a toner restricting member and rotated, toner is supplied to an image holding body by the toner layer, a toner image is formed onto the image holding body, the toner image is transferred onto a print medium, and an image is formed. The image forming apparatus comprises a counting section which counts the toner image, on a dot unit basis, which is formed on the image holding body; and a control section which changes a voltage that is applied to the developing roller when a count value of the counting section is equal to or larger than a predetermined reference value.

Moreover, the image forming apparatus may further comprise a supplying roller which supplies the toner to the developing roller, and wherein the control section which changes a voltage that is applied to the supplying roller when the count value is equal to or larger than the predetermined reference value.

Moreover, in the image forming apparatus, the counting section counts the toner image, on a dot unit basis, which is formed in each of sections obtained by dividing the image at predetermined intervals in a main scanning direction on the image holding body; and when a count value is equal to or larger than a predetermined reference value in one of the sections, the control section changes the voltage that is applied to the developing roller.

Moreover, in the image forming apparatus, the image holding body is a photosensitive drum; the apparatus has rotating number counting section which counts the number of rotating times of the photosensitive drum when the count value is equal to or larger than the predetermined reference value; and the control section changes the voltage when a rotation count value exceeds a predetermined rotation reference value.

Moreover, the image forming apparatus may further comprise either temperature measuring section or moisture measuring section; and a correcting section which corrects the reference value on the basis of information from the measuring section.

Moreover, the image forming apparatus may further comprise either temperature measuring section or moisture measuring section; and correcting section which corrects the rotation reference value on the basis of information from the measuring section.

According to the image forming apparatus of the invention, the toner image is counted on a dot unit basis and when the print duty is high, a series of image forming control is intermittently controlled, thereby making it possible to reduce the toner temperature of the toner layer which is intermittently formed on the developing roller. Thus, the occurrence of the filming due to the increase in the toner temperature can be prevented.

Further, according to the image forming apparatus of the invention, the toner image is counted on a dot unit basis, when the print duty is high, the voltages which are applied to the developing roller and the supplying roller are adjusted, and an amount of toner which is supplied to the developing roller is increased, so that an enough amount of toner is also supplied to the portion of the low thickness dimension in the toner layer after the toner supply. Thus, since the energy generated by the depression of the toner restricting member can be received by a large number of toner particles and the energy can be dispersed by each toner particle, the vibration among the toner particles can be suppressed and the generation of the frictional heat due to the vibration can be suppressed. Consequently, according to the image forming apparatus of the invention, the increase in the toner temperature can be prevented and the occurrence of the filming can be prevented.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

Figure 1:
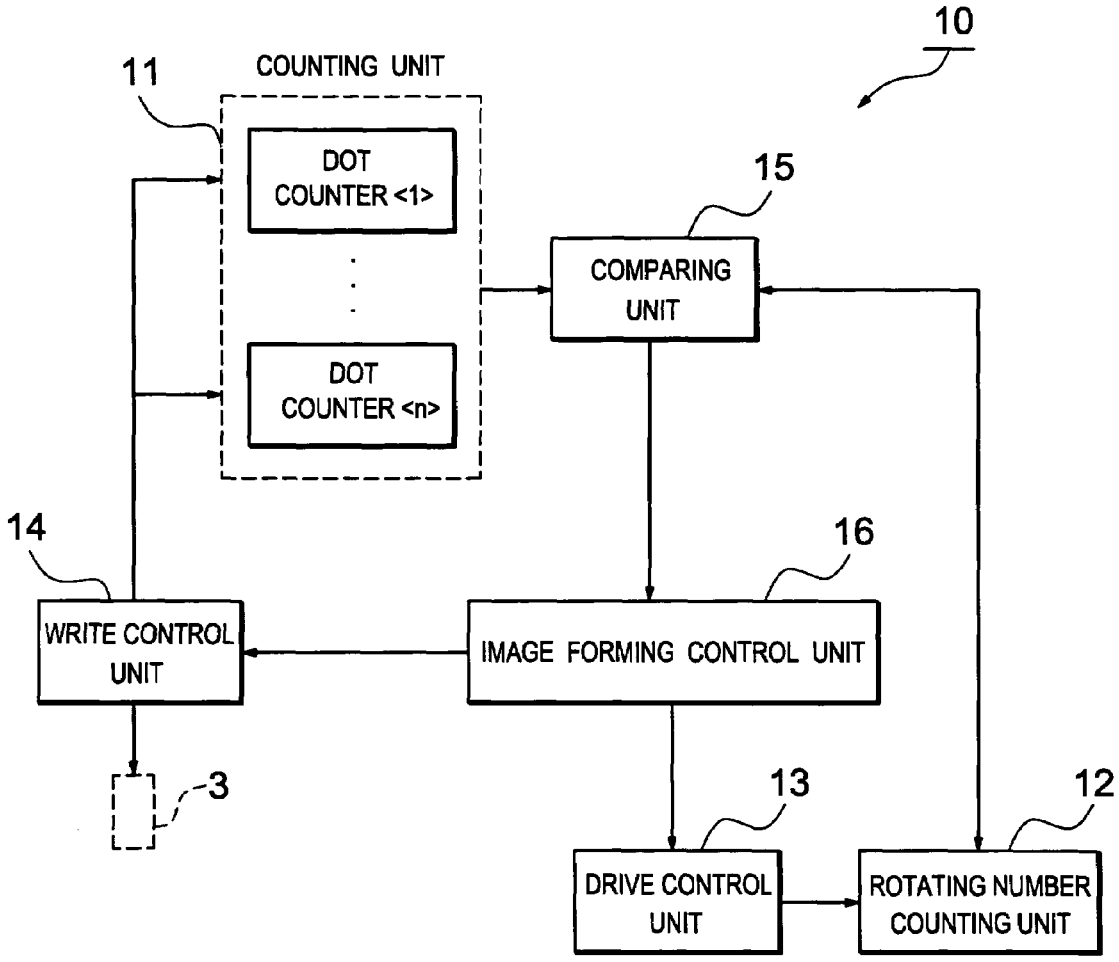
FIG. 1 is a block diagram of an image forming apparatus of the embodiment 1.

An embodiment of the invention will be described in detail hereinbelow with reference to the drawings. In the following explanation, the same or similar component elements in the drawings which are used in the embodiments are designated by the same reference numerals and their overlapped explanation is omitted as much as possible.

Embodiment 1

As shown in FIG. 1, an image forming apparatus 10 of the invention comprises: a counting unit 11 for counting the number of dots of a toner image to be formed; a rotating number counting unit 12 for counting the number of rotating times of a photosensitive drum, which will be explained hereinafter; a drive control unit 13 for controlling the driving of mechanisms such as a photosensitive drum and the like; a write control unit 14 for controlling an exposing unit 3 to expose the photosensitive drum in correspondence to the image to be formed; a comparing unit 15 for comparing a count value obtained from the counting unit 11 with a predetermined reference value and comparing a count value indicative of the number of rotating times obtained from the rotating number counting unit 12 with a predetermined rotation count value; and an image forming control unit 16 for controlling each of the above units so as to intermittently make image forming control on the basis of a comparison result of the comparing unit 15.

Figure 2:
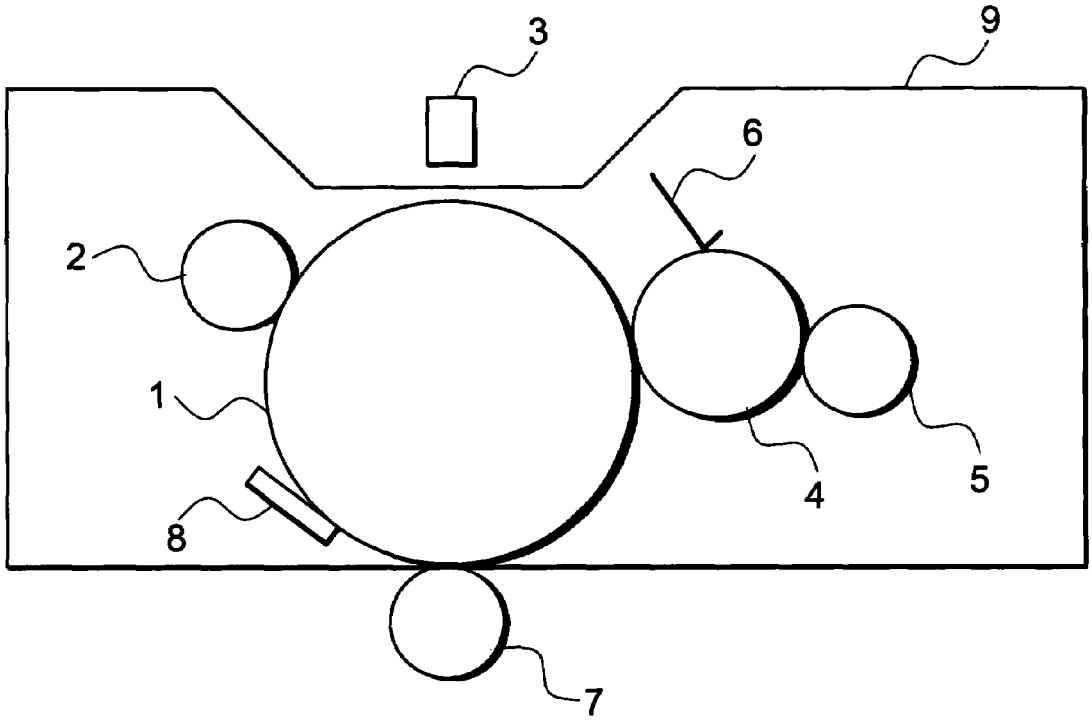
FIG. 2 is a mechanical block diagram of the image forming apparatus of the invention.

Prior to explaining each of the above units in detail, an image forming mechanism in the image forming apparatus 10 will be explained with reference to FIG. 2.

A principal mechanism for forming the image comprises: a photosensitive drum 1 serving as an image holding body; a charging roller 2 for charging the photosensitive drum 1 to an arbitrary polarity (for example, minus (−)); the exposing unit 3 for exposing the charged surface of the photosensitive drum, thereby forming an electrostatic latent image; a developing roller 4 for supplying toner onto the photosensitive drum 1 and forming a toner image corresponding to the electrostatic latent image onto the photosensitive drum 1; a supplying roller 5 for supplying the toner onto the developing roller 4; a toner restricting member 6 for restricting the toner supplied to the developing roller 4 and forming a toner layer onto the developing roller 4; a transfer member 7 for transferring the toner image formed on the photosensitive drum 1 onto a print medium, thereby forming an image; and a cleaning unit 8 for cleaning the toner remaining on the photosensitive drum 1 after the transfer. The photosensitive drum 1 and each of the above rollers are rotated by a driving source (not shown) in order to form the image.

A construction comprising the photosensitive drum 1, charging roller 2, developing roller 4, supplying roller 5, toner restricting member 6, and cleaning unit 8 is referred to as an image drum unit 9 (hereinbelow, abbreviated to ID 9) and explanation will be made hereinbelow.

The photosensitive drum 1 is an organic system photosensitive body which has conventionally been known. The surface of the photosensitive drum 1 is charged to, for example, a minus polarity (−) by the charging roller 2.

The exposing unit 3 irradiates light of an LED or a laser beam onto the charged surface of the photosensitive drum under control of the write control unit, thereby forming an electrostatic latent image corresponding to a print pattern (image) onto the photosensitive drum 1.

The developing roller 4 supplies the toner onto the photosensitive drum 1 so as to form the toner image by developing the electrostatic latent image on the photosensitive drum 1. The toner to be supplied has been formed in a thin layer shape on the developing roller 4. The toner image is formed on the photosensitive drum 1 by the toner which is supplied from the toner layer onto the photosensitive drum 1.

A predetermined voltage is applied to the developing roller 4 and the toner is held on the developing roller 4 by the voltage supply. A holding amount of the toner corresponds to a value of the applied voltage. The higher the voltage which is applied to the developing roller 4 rises, the more the amount of toner held on the developing roller 4 increases.

The supplying roller 5 is in contact with the developing roller 4 so as to convey the toner onto the developing roller 4.

A voltage is also applied to the supplying roller 5 and the toner is also held on the supplying roller 5 by the voltage supply.

The toner restricting member 6 is in contact with the developing roller 4 at a predetermined pressure. The toner supplied onto the developing roller 4 from the supplying roller 5 receives the predetermined pressure by the toner restricting member 6 so as to be a thin toner layer of a predetermined thickness dimension. In this instance, the toner over the predetermined thickness dimension is restricted by the toner restricting member 6 and removed.

The toner restricting member 6 has a shape of a thin plate whose thickness dimension is equal to, for example, 0.08 mm. A length in the longitudinal direction corresponds to a width dimension of the developing roller 4 and an edge in the longitudinal direction is fixed to a frame (not shown). The toner restricting member 6 is arranged so that the surface which is slightly bent from the tip is come into contact with the developing roller 4 at the predetermined pressure.

The functional block of FIG. 1 will be explained again.

The write control unit 14 controls the exposing unit 3 so as to expose the charged surface of the photosensitive drum 1, thereby forming the electrostatic latent image. Since the toner is deposited onto the electrostatic latent image, the toner image is formed onto the photosensitive drum 1.

The drive control unit 13 controls the driving of each mechanism of the ID 9 and controls the drive timing of the transfer member 7.

The rotating number counting unit 12 counts the number of rotating times of the photosensitive drum 1 whose drive timing is controlled by the drive control unit 13 and notifies the comparing unit 15 of a count value as a rotation count value.

Prior to forming the toner image, the counting unit 11 has a plurality of (n) dot counters each for counting the number of dots of the toner image to be formed on the photosensitive drum 1. The toner image is formed on the basis of the image data. Information to form the image by a set of pixels is shown in the image data. The counting unit 11 counts the numbers of present/absent pixels shown in the image data. As shown in a schematic development diagram of an outer periphery of the photosensitive drum 1 in FIG. 3, those numbers of pixels are counted by the following method. That is, in the case where the toner image based on the image data is formed on the photosensitive drum 1, the toner image is divided into n sections at regular width intervals in the main scanning direction. In each section of one print medium, the number of dots of the toner image in the sub-scanning direction (running direction of the print medium when the toner image is made to correspond to the print medium) is counted by each dot counter.

Figure 3:
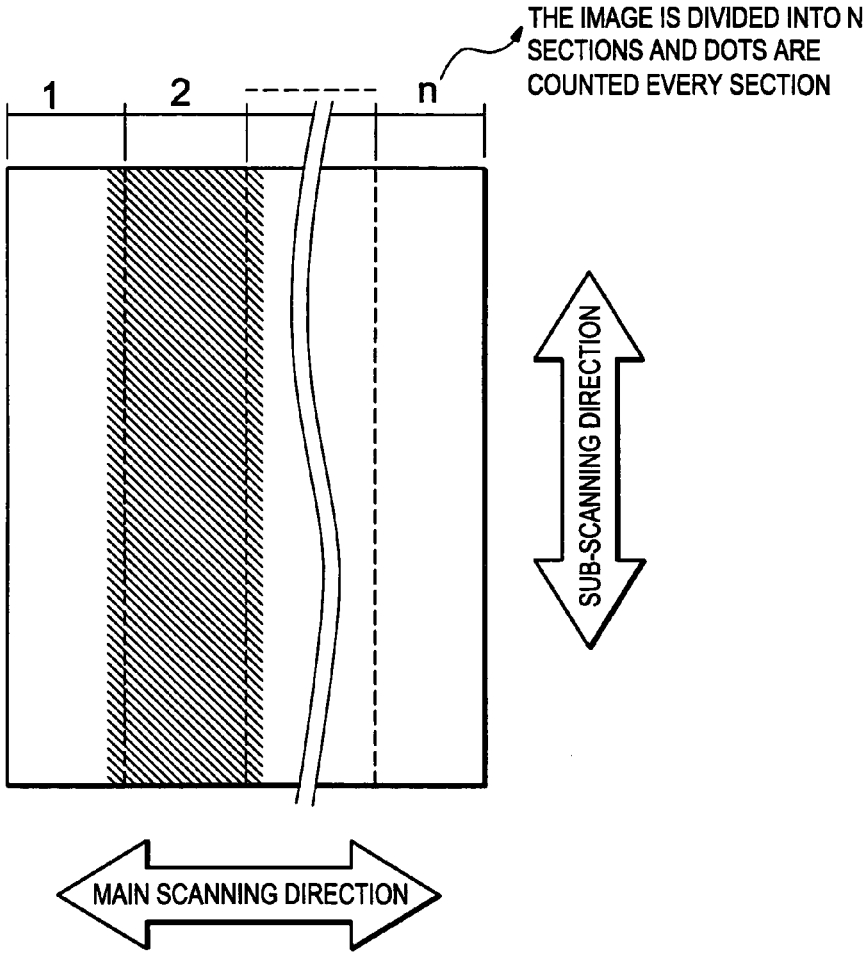
FIG. 3 is a schematic development diagram of an outer periphery of a photosensitive drum 1.

In each section shown in FIG. 3, a length of section in the sub-scanning direction is specified by the number of rotating times of one print medium which is counted by the rotating number counting unit 12.

An example of counting the number of dots of the toner image which is formed on the outer periphery of the photosensitive drum will be explained here. For example, the number of pixels (the number of dots) of the toner image in the print medium can be also counted if the outer periphery of the photosensitive drum 1 is converted into the print medium of the A4 size or the like. In such a case, in the case of the width of A4 size, it is desirable to set the number (n) of sections to about 10.

The comparing unit 15 obtains the number of dots (count value), as a print duty, in the section area of one print medium which is specified by the rotation count value on the basis of the count value from the counting unit 11 and the rotation count value from the rotating number counting unit 12, compares the print duty with a predetermined reference value, and also compares the rotation count value from the rotating number counting unit 12 with a predetermined rotation reference value.

After the comparing unit 15 obtains the print duty every count value counted by each dot counter of the counting unit 11, it compares the print duty with the predetermined reference value and notifies the image forming control unit 16 of a comparison result.

When one of the n print duties derived from the comparing unit 15 is larger than the predetermined reference value, the image forming control unit 16 instructs the drive control unit 13 and the write control unit 14 to determine whether the continuous print control is continued or the intermittent print control is executed on the basis of the result of the comparison between the rotation count value from timing L2 (refer to FIG. 4) and the predetermined reference value.

The intermittent printing in the embodiment denotes the printing in which the rotation of the photosensitive drum 1, developing roller 4, supplying roller 5, and the like is stopped and the printing operation is stopped for a predetermined period of time. For example, the operation in which when the print control of three print media is finished, a predetermined pause period is provided, and thereafter, the print control of three print media is made is repeated. The number of print media in the print control is not limited to three but may be also properly set to an arbitrary value.

The operation in the image forming control unit 16 will now be described with reference to timing charts.

Figure 4:
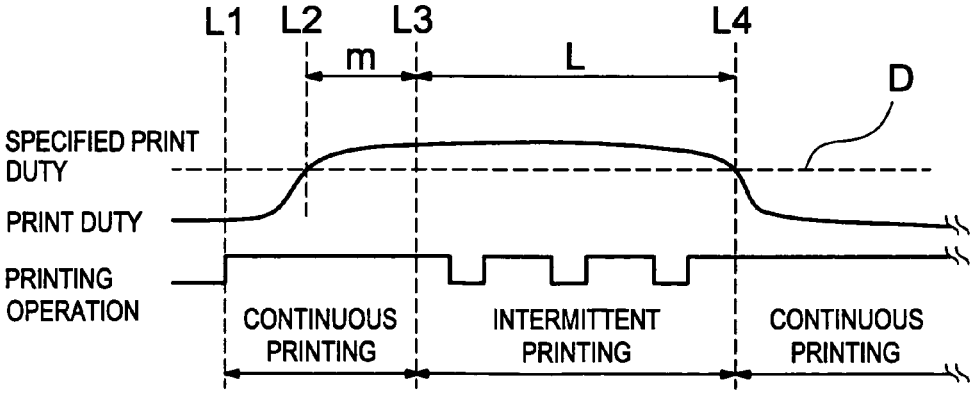
FIG. 4 is a time chart for the operation of the image forming apparatus of the embodiment 1.

As shown in FIG. 4, each print duty is compared with a predetermined reference value D by the comparing unit 15. When one of the print duties is equal to or larger than the predetermined reference value D (L2), the image forming control unit 16 instructs the comparing unit 15 to compare the rotation count values of the photosensitive drum 1 after timing L2 with a predetermined rotation reference value m. If the rotation count value is equal to or larger than the predetermined rotation reference value (L3) in the comparison result, the image forming control unit 16 instructs the drive control unit 13 and the write control unit 14 to switch the control mode from the continuous print control to the intermittent print control.

The image forming control unit 16 always continues to confirm the comparison result from the comparing unit 15 for comparing the count values from the counting unit 11 with the predetermined reference value. In the comparison result from the comparing unit 15 for comparing the count values from the counting unit 11 with the predetermined reference value, if the rotation count value after timing L3 in the timing chart of FIG. 4 is equal to or less than a predetermined reference value L (L4), the image forming control unit 16 instructs the drive control unit 13 and the write control unit 14 to switch the control mode from the intermittent print control to the continuous print control.

On the other hand, it is desirable to set the reference value D to 60% or more and it is preferable to set the rotation reference value m to the number of rotating times of the photosensitive drum 1 which is necessary for the printing of about 40 print media of the A4 size if the outer periphery of the photosensitive drum 1 is converted into the print medium of the A4 size.

The reference value L is set to the number of rotating times of the drum corresponding to about 50 print media. In place of the reference value L, the print mode can be also switched when the print duty is equal to or less than D.

Figure 5:
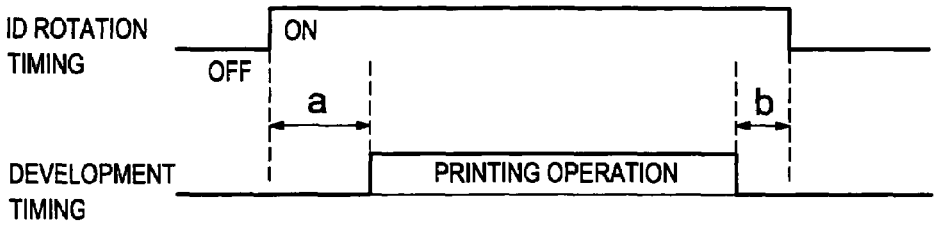
FIG. 5 is a time chart for the printing operation and the stopping operation.

The operating mode in which the toner of the toner layer on the developing roller 4 is supplied to the photosensitive drum 1, the electrostatic latent image is developed, and the toner image is formed is called "development timing". The operation rotating mode of each mechanism in the ID 9 is called "ID timing". The relation between the ID timing and the development timing will be described with reference to the timing chart of FIG. 5.

After the ID timing enters the operating mode, the development timing enters the operating mode after the elapse of a predetermined period (a). That is, after the photosensitive drum 1 starts the rotation at the ID rotation timing, the creation of the toner image is started after the elapse of the period (a). By starting the creation of the toner image after the elapse of the period (a), the creation of the electrostatic latent image on the photosensitive drum 1 and the creation of the toner layer on the developing roller 4 can be stabilized.

Further, when a predetermined period (b) elapses after the development timing entered the pause mode, the ID timing enters the pause mode. That is, the period (b) is a time until the ID 9 is actually stopped after the development timing entered the pause mode. Each mechanism of the ID 9 enters an idling mode for the period (b).

No toner is supplied to the photosensitive drum 1 from the toner layer on the developing roller 4 for the periods (a) and (b) and the toner layer on the developing roller 4 is reproduced for such periods of time. After the toner layer was reproduced, each mechanism of the ID 9 is stopped. Since the ID 9 is stopped, no friction occurs between the developing roller 4 and the photosensitive drum 1, supplying roller 5, and toner restricting member 6 and the toner temperature of the toner layer between the developing roller 4 and the toner restricting member 6 can be lowered.

As mentioned above, according to the image forming apparatus 10 of the embodiment 1, the toner image is counted on a dot unit basis and when the print duty is high, the image forming control unit 16 instructs the drive control unit 13 and the write control unit 14 to intermittently make the series of image forming control. Therefore, the toner temperature of the toner layer on the developing roller 4 can be lowered for the stop period of time in the intermittent control. The occurrence of the filming due to the increase in the toner temperature can be prevented.

For example, in the print medium of the A4 size, in the case of continuously printing a rod line having a predetermined width along the longitudinal direction (sub-scanning direction), although the print duty is low as a whole in the A4 size, the print duty is high as far as the periphery of the rod line portion and there is a risk that the filming occurs in the periphery of the rod line portion. However, according to the image forming apparatus 10 of the embodiment 1, the print duties in the n sections are obtained and the comparison discrimination about whether or not the intermittent control is made is performed on the basis of each of the obtained print duties. Therefore, even in the creation of the image whose print duty is partially high, the occurrence of the filming can be prevented.

Embodiment 2

An image forming apparatus 20 which measures a temperature and a moisture and corrects the reference value and the rotation reference value on the basis of measurement result will now be described.

Figure 6:
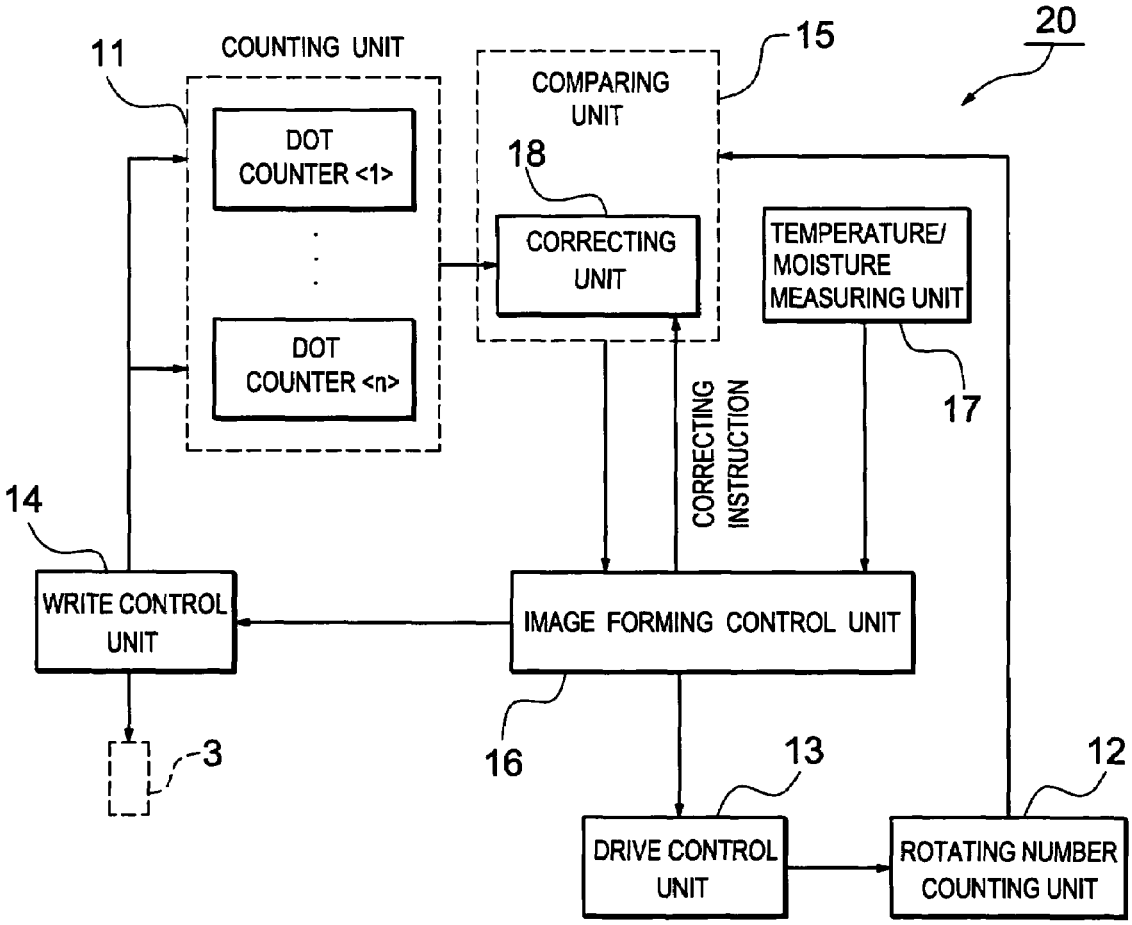
FIG. 6 is a block diagram of an image forming apparatus of the embodiment 2.

In a manner similar to the foregoing embodiment 1, as shown in FIG. 6, the image forming apparatus 20 of the embodiment 2 comprises: the counting unit 11; the rotating number counting unit 12; the drive control unit 13; the write control unit 14; the comparing unit 15 for comparing the count value obtained from the counting unit 11 with the predetermined reference value and comparing the rotation count value from the rotating number counting unit 12 with the predetermined rotation reference value; and the image forming control unit 16 for controlling each of the above units so as to intermittently make image forming control on the basis of the comparison result of the comparing unit 15. The image forming apparatus 20 further comprises: a temperature/moisture measuring unit 17 for measuring the temperature and the moisture; and a correcting unit 18 for correcting the reference value and the rotation reference value which are used for the comparing process in the comparing unit 15 in accordance with a measurement result in the temperature/moisture measuring unit 17.

The temperature/moisture measuring unit 17 measures the temperature and the moisture of the peripheral atmosphere in the ID 9 and notifies the image forming control unit 16 of the measurement result.

The image forming control unit 16 which obtained the measurement result instructs the comparing unit 15 to correct the reference value and the rotation reference value in correspondence to the measurement result.

In the atmosphere of the high temperature and the high moisture, generally, there is a tendency that charging performance of the toner deteriorates and the thickness dimension of the toner layer on the developing roller 4 decreases. The energy which is received by the toner particles per unit due to the depression by the toner restricting member 6 increases and the filming in which the toner has the heat and is melt-bonded to the toner restricting member 6 is liable to occur. In the atmosphere of the low temperature and the low moisture, on the contrary, since the charging performance of the toner is good, the filming hardly occurs.

The reference value and the rotation reference value are corrected in the correcting unit 18 in accordance with a change in the atmosphere.

When the correcting instruction is received from the image forming control unit 16, the correcting unit 18 corrects the reference value and the rotation reference value in correspondence to the measurement result measured by the temperature/moisture measuring unit 17. That is, in the atmosphere of the high temperature and the high moisture, the correcting unit 18 corrects the reference value D and the rotation reference value (m, L) so as to be low.

Thus, in the atmosphere of the high temperature and the high moisture, the shift of the control mode from the continuous print control to the intermittent print control can be instructed at the lower print duty and in the shorter time as compared with those in the atmosphere of the ordinary temperature and moisture. Further, also in the case of shifting the control mode from the intermittent print control to the continuous print control, the shift of the control mode from the intermittent print control to the continuous print control can be instructed at the reference value lower than that in the atmosphere of the ordinary temperature and moisture, that is, at the lower print duty.

The correcting unit 18 may also correct only either the reference value or the rotation reference value in the above correcting process.

As mentioned above, according to the image forming apparatus 20 of the embodiment 2, by correcting the reference value and the rotation reference value in the correcting unit 18 on the basis of the measurement result from the temperature/moisture measuring unit 17, the reference value and the rotation reference value are set to be low in the case where the filming is liable to occur in the atmosphere of the high temperature and the high moisture. Thus, according to the image forming apparatus 20 of the embodiment 2, the timing for making the intermittent print control can be made early on the basis of the set low reference value and the set low rotation reference value and the timing for recovering the control mode from the intermittent print control to the continuous print control can be delayed. Consequently, in the environment in which the filming is liable to occur, the occurrence of the filming can be prevented.

Embodiment 3

An image forming apparatus in which the voltages that are applied to the developing roller 4 and the supplying roller 5 are controlled in accordance with the print duty will now be described.

Figure 7:
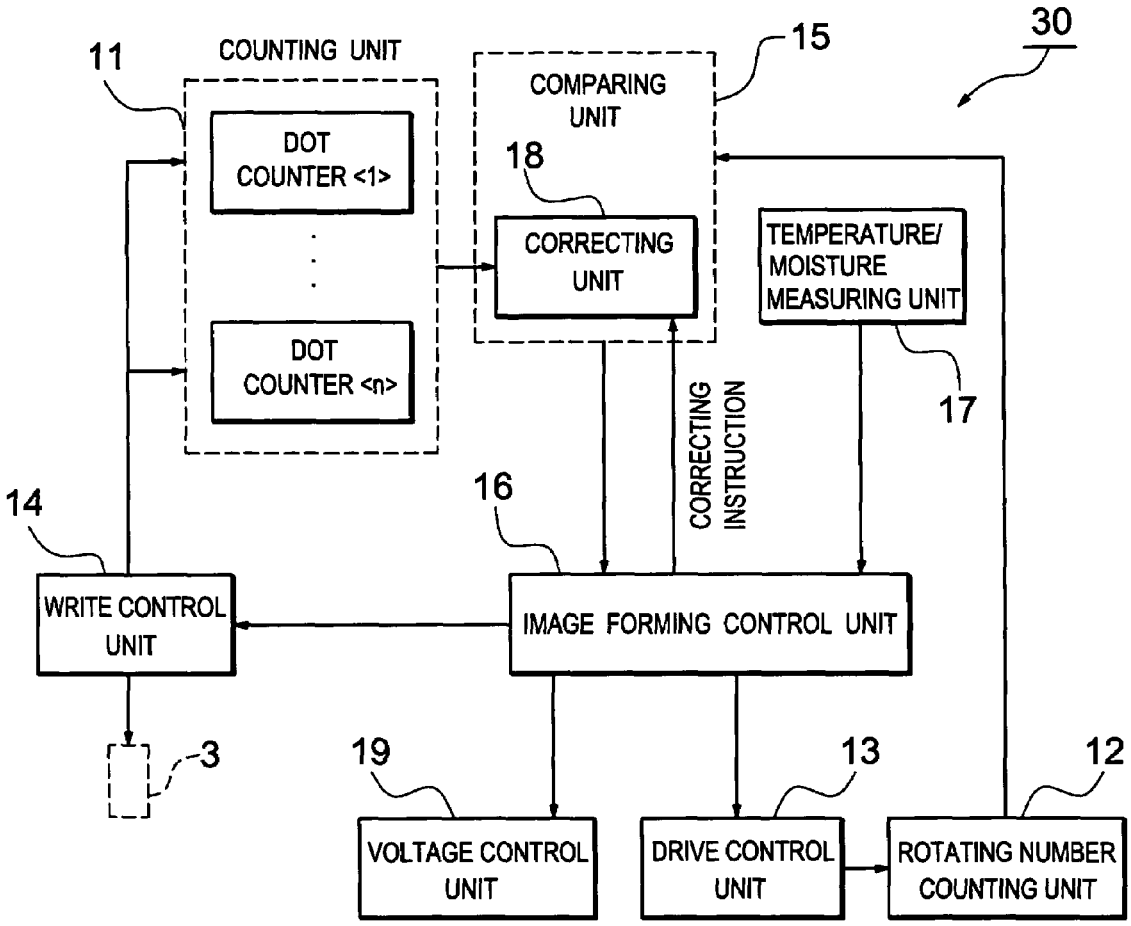
FIG. 7 is a block diagram of an image forming apparatus of the embodiment 3.

As shown in FIG. 7, a construction of an image forming apparatus 30 of the embodiment 3 is obtained by adding a voltage control unit 19 for controlling the voltages which are applied to the developing roller 4 and the supplying roller 5 to the construction of the foregoing image forming apparatus of the embodiment 2.

The voltage control unit 19 controls the voltages which are applied to the developing roller 4 and the supplying roller 5 in accordance with an instruction from the image forming control unit 16. Since the voltages which are controlled by the voltage control unit 19 are applied to the developing roller 4 and the supplying roller 5, the holding performance of the toner in the developing roller 4 and the supplying roller 5 is improved. The holding performance of the toner is improved in accordance with the levels of the voltages which are applied.

The image forming control unit 16 for instructing the voltage control unit 19 to make the voltage control instructs the voltage control to the voltage control unit 19 on the basis of the measurement result from the temperature/moisture measuring unit 17 and the comparison result between the print duty and the reference value D from the comparing unit 15.

The relation between the voltages which are controlled by the voltage control unit 19 and the toner amount on the developing roller 4 will now be described with reference to the timing chart.

Figure 8:
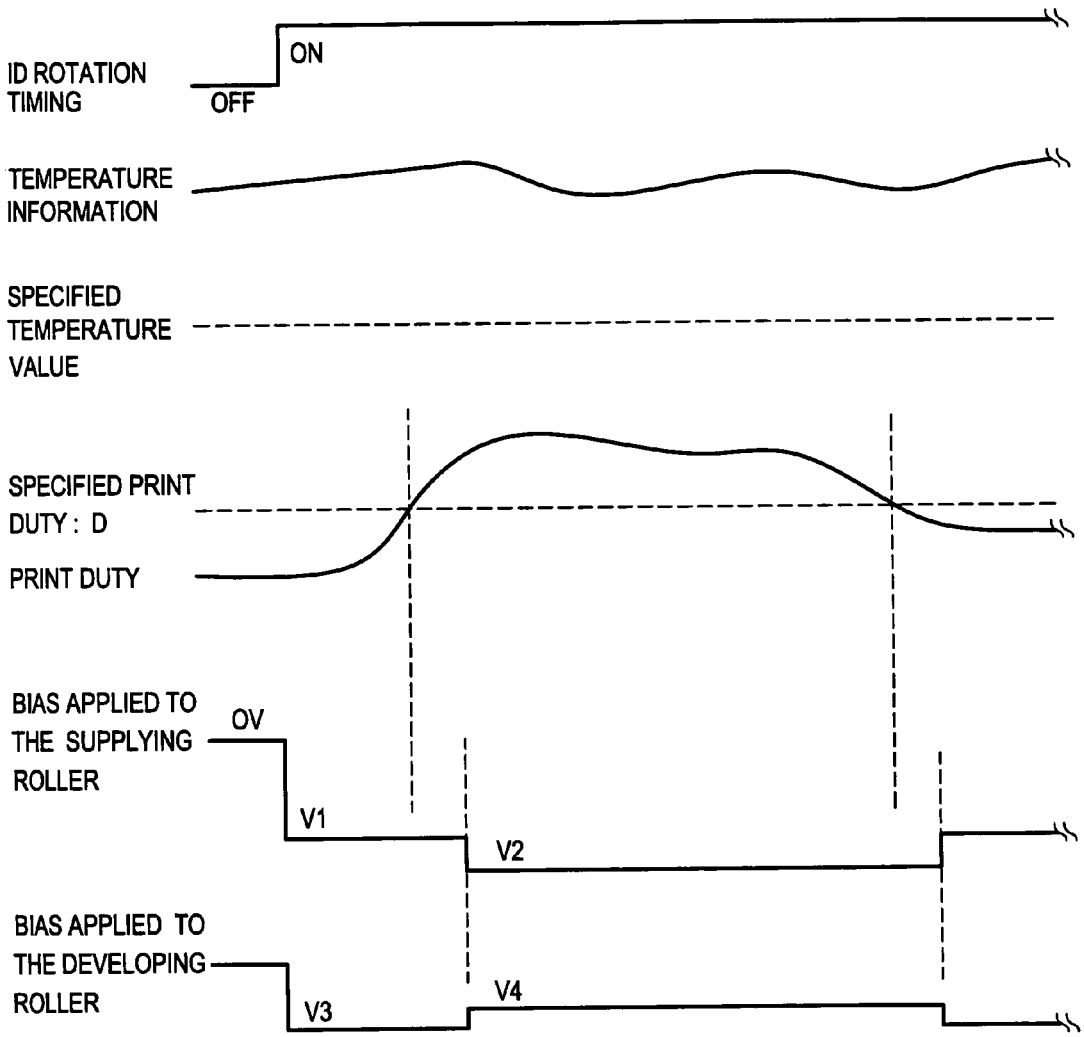
FIG. 8 is a time chart for the operation of the image forming apparatus of the embodiment 3 (temperature is high)

The relations among the rotation timing of the ID 9, temperature information showing the relation with the specified temperature, the print duty whose relation with the predetermined reference value D is shown, a value of the voltage which is applied to the developing roller 4, and a value of the voltage which is applied to the supplying roller 5 are time-sequentially shown in the timing chart of FIG. 8.

When the print duty is lower than the predetermined reference value D, a voltage V1 is applied to the supplying roller 5 and a voltage V3 is applied to the developing roller 4. The toner of an amount shown by a1 has been deposited (as a thin toner layer) onto the developing roller 4 to which the voltage V3 is applied. If the amount of toner which is supplied from the developing roller 4 to the photosensitive drum 1 is converted into developing efficiency, the developing efficiency of b1 % is obtained.

Since the developing efficiency is efficiency at which the toner is supplied from the developing roller 4 to the photosensitive drum 1, for example, if the amount of toner which is supplied from the developing roller 4 to the photosensitive drum 1 is constant and the amount of toner which is held by the developing roller 4 increases, the developing efficiency deteriorates inevitably.

As shown in FIG. 8, when the temperature of the atmosphere of the ID 9 is higher than the ordinary temperature (for example, 20° C.) and the print duty is higher than the reference value D, the image forming control unit 16 makes the intermittent print control, thereafter, instructs the voltage control unit 19 to lower the voltage which is applied to the supplying roller 5 from V1 to V2 (where, $|V1|<|V2|$), and instructs the voltage control unit 19 to raise the voltage which is applied to the developing roller 4 from V3 to V4 (where, $|V3|>|V4|$).

At this time, the voltage V2 lower than the voltage V1 is applied to the supplying roller 5 and the toner of the amount (shown at a2) larger than that before the voltage change is deposited onto the developing roller 4 to which the voltage V4 higher than the voltage V3 is applied. In this instance, the amount of toner which is supplied from the developing roller 4 to the photosensitive drum 1 corresponds to the developing efficiency of b2% (where, $a1<a2$, $b1>b2$).

A value of the product of the toner amount a1 and the developing efficiency b1 % and a value of the product of the toner amount a2 and the developing efficiency b2% are almost equal. In other words, by controlling the voltages which are applied to the rollers 4 and 5, although the amount of toner which is held on the developing roller 4 increases, the developing efficiency deteriorates. Consequently, the substantial amount of toner which is supplied from the developing roller 4 to the photosensitive drum 1 is substantially the same as that before the voltage change.

Therefore, when the print duty becomes higher than the reference value D, a large amount of toner is supplied from the supplying roller 5 to the developing roller 4 and the toner particles are sufficiently supplemented also to the portion of the toner layer of the low thickness dimension. Thus, the energy generated by the depression of the toner restricting member 6 can be dispersively received by a large number of toner particles containing the supplemented toner. The friction of the toner which is caused by the concentration of the energy can be prevented and the generation of the frictional heat can be prevented. Further, even if the toner is heated in the portion depressed by the toner restricting member 6, the heat is conducted to the large amount of supplied toner and diffused, so that the pin-point heat generation can be prevented.

Figure 9:
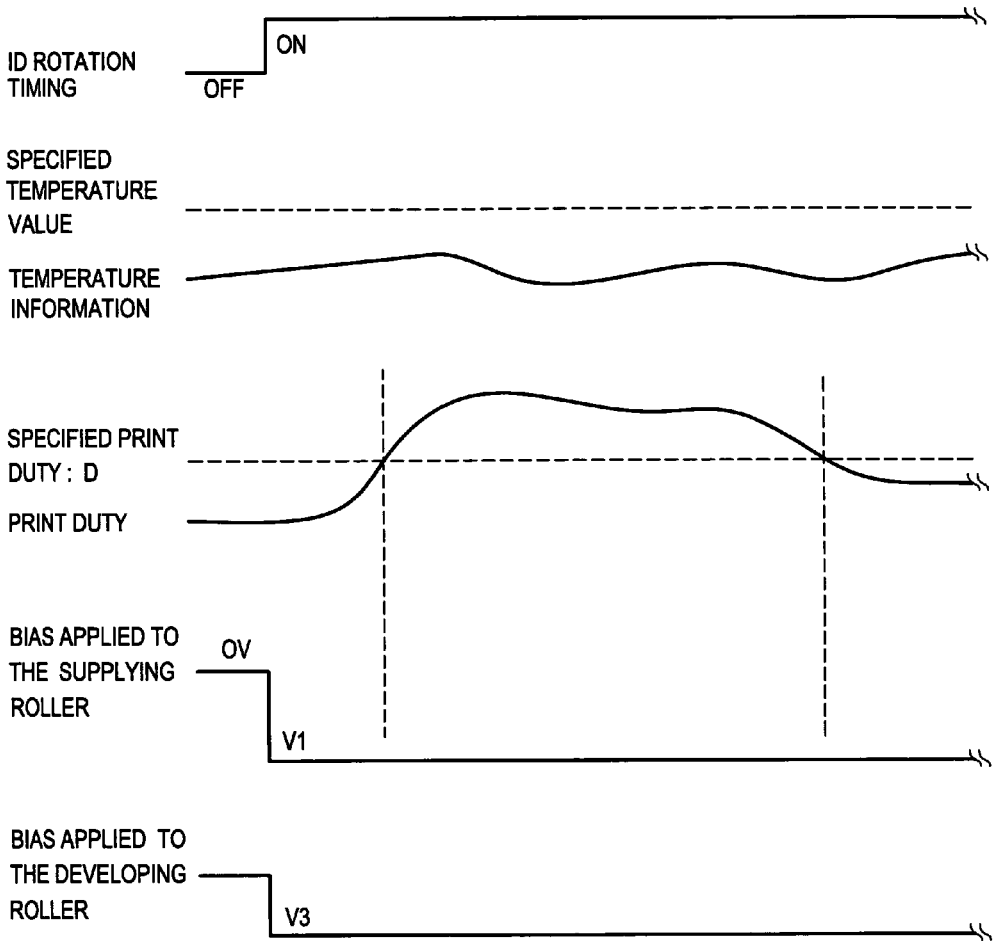
FIG. 9 is a time chart for the operation of the image forming apparatus of the embodiment 3 (temperature is low).

Subsequently, the relation between the voltages which are controlled by the voltage control unit 19 in the case where the temperature of the atmosphere of the ID 9 is lower than the ordinary temperature and the amount of toner on the developing roller 4 will be described with reference to the timing chart of FIG. 9.

The inventors have confirmed that when the temperature of the atmosphere of the ID 9 is lower than the ordinary temperature, even if the voltages which are applied to the developing roller 4 and the supplying roller 5 are changed in a manner similar to the case where the temperature of the atmosphere of the ID 9 is higher than the ordinary temperature, the amount of toner which is supplied from the toner layer on the developing roller 4 to the photosensitive drum 1 is not changed and the apparent toner amount in the print result is not changed, either.

Therefore, when the temperature of the atmosphere of the ID 9 is lower than the ordinary temperature and the print duty is higher than the reference value D, the image forming control unit 16 does not instruct the voltage change control, but the voltage V1 is continuously applied to the supplying roller 5 and the voltage V3 is continuously applied to the developing roller 4.

As mentioned above, according to the image forming apparatus 30 of the embodiment 3, the temperature of the atmosphere of the ID 9 is measured and when the measurement value is higher than the ordinary temperature and the print duty is higher than the reference value D, the voltages which are applied to the developing roller 4 and the supplying roller 5 are adjusted so as to increase the toner amount on the developing roller 4. Thus, since the toner particles are sufficiently supplemented also to the portion of the toner layer of the low thickness dimension, the energy generated by the depression of the toner restricting member 6 can be dispersively received by a large number of toner particles containing the supplemented toner. The friction of the toner can be prevented and the heat generation of the toner can be prevented. Therefore, according to the image forming apparatus 30 of the embodiment 3, the filming which is caused since the toner is melt-bonded to the toner restricting member 6 by the heat generation can be prevented.

Although the invention has been described above with respect to the example in which the temperature is used as a measurement result from the temperature/moisture measuring unit 17, it is not always necessary to limit the invention to such an example. It is also possible to construct in such a manner that the temperature/moisture measuring unit 17 notifies the image forming control unit 16 of the information of either the temperature or the moisture as a measurement result and the image forming control unit 16 instructs the voltage control unit 19 to make the voltage control on the basis of the measurement result.

Although the image forming control unit 16 has intermittently controlled the image drum unit 9 in each of the foregoing embodiments, an operating speed of the image drum unit 9 may be also controlled so as to be a low speed.

The invention can be also applied to various image forming apparatuses such as printer, copying apparatus, facsimile apparatus, multifunction apparatus, and the like, in which an image is formed by transferring a toner image onto a print medium.

It should be understood by those skilled in the art that various modifications, combinations, sub-combinations and alterations may occur depending on design requirements and other factors insofar as they are within the scope of the appended claims or the equivalents thereof.

What is claimed is:

1. An image forming apparatus in which a toner layer is formed onto a developing roller which is restricted by a toner restricting member and rotated, toner is supplied to an image holding body by said toner layer, a toner image is formed onto said image holding body, the toner image is transferred onto a print medium, and an image is formed, comprising:

counting section which counts the toner image, on a dot unit basis, which is formed on the image holding body; and control section which restricts the rotation of said developing roller when a count value of said counting section is equal to or larger than a predetermined reference value.

2. The image forming apparatus according to claim 1, wherein:

said counting section counts the toner image, on a dot unit basis, which is formed in each of sections obtained by dividing the image at predetermined intervals in a main scanning direction on said image holding body; and when a count value is equal to or larger than a predetermined reference value in one of said sections, said control section executes intermittent control.

3. The image forming apparatus according to claim 1, wherein:

said image holding body is a photosensitive drum;

said apparatus has rotating number counting section which counts the number of rotating times of said photosensitive drum when said count value is equal to or larger than said predetermined reference value; and said control section executes intermittent control when a rotation count value exceeds a predetermined rotation reference value.

4. The image forming apparatus according to claim 3, further comprising:

either temperature measuring section or moisture measuring section; and correcting section which corrects said rotation reference value on the basis of information from said measuring section.

5. The image forming apparatus according to claim 3, further comprising either temperature measuring section or moisture measuring section, and wherein said control section changes an intermittent time in said intermittent control on the basis of information from said measuring section.

6. The image forming apparatus according to claim 1, further comprising:

either temperature measuring section or moisture measuring section; and correcting section which corrects said reference value on the basis of information from said measuring section.

7. The image forming apparatus according to claim 1, wherein the toner restricting member has a bent tip and wherein a surface of the bent tip contacts the developing roller.

8. An image forming apparatus in which a toner layer is formed onto a developing roller which is restricted by a toner restricting member and rotated, toner is supplied to an image holding body by said toner layer, a toner image is formed onto said image holding body, the toner image is transferred onto a print medium, and an image is formed, comprising:

counting section which counts the toner image, on a dot unit basis, which is formed on the image holding body;

control section which changes a voltage that is applied to said developing roller when a count value of said counting section is equal to or larger than a predetermined reference value;

a supplying roller which supplies the toner to said developing roller, and wherein said control section which changes a voltage that is applied to said supplying roller when said count value is equal to or larger than said predetermined reference value.

9. The image forming apparatus according to claim 8, wherein the toner restricting member has a bent tip and wherein a surface of the bent tip contacts the developing roller.

10. The image forming apparatus according to claim 8, wherein:

said counting section counts the toner image, on a dot unit basis, which is formed in each of sections obtained by dividing the image at predetermined intervals in a main scanning direction on said image holding body; and when a count value is equal to or larger than a predetermined reference value in one of said sections, said control section changes the voltage that is applied to said developing roller.

11. The image forming apparatus according to claim 8, further comprising:

either temperature measuring section or moisture measuring section; and correcting section which corrects said reference value on the basis of information from said measuring section.

12. The image forming apparatus according to claim 8, further comprising a voltage control unit controlled by the control section to change the voltage applied to the supplying roller from V1 to V2, wherein an absolute value of V2 is greater than an absolute value of V1.

13. An image forming apparatus in which a toner layer is formed onto a developing roller which is restricted by a toner restricting member and rotated, toner is supplied to an image holding body by said toner layer, a toner image is formed onto said image holding body, the toner image is transferred onto a print medium, and an image is formed, comprising:

counting section which counts the toner image, on a dot unit basis, which is formed on the image holding body;

control section which changes a voltage that is applied to said developing roller when a count value of said counting section is equal to or larger than a predetermined reference value; wherein:

said counting section counts the toner image, on a dot unit basis, which is formed in each of sections obtained by dividing the image at predetermined intervals in a main scanning direction on said image holding body; and when a count value is equal to or larger than a predetermined reference value in one of said sections, said control section changes the voltage that is applied to said developing roller.

14. The image forming apparatus according to claim 13, wherein the toner restricting member has a bent tip and wherein a surface of the bent tip contacts the developing roller.

15. An image forming apparatus in which a toner layer is formed onto a developing roller which is restricted by a toner restricting member and rotated, toner is supplied to an image holding body by said toner layer, a toner image is formed onto said image holding body, the toner image is transferred onto a print medium, and an image is formed, comprising:

counting section which counts the toner image, on a dot unit basis, which is formed on the image holding body;

control section which changes a voltage that is applied to said developing roller when a count value of said counting section is equal to or larger than a predetermined reference value; wherein:

said image holding body is a photosensitive drum;

said apparatus has rotating number counting section which counts the number of rotating times of said photosensitive drum when said count value is equal to or larger than said predetermined reference value; and said control section changes said voltage when a rotation count value exceeds a predetermined rotation reference value.

16. The image forming apparatus according to claim 15, further comprising:

either temperature measuring section or moisture measuring section; and correcting section which corrects said rotation reference value on the basis of information from said measuring section.

17. An image forming apparatus in which a toner layer is formed onto a developing roller which is restricted by a toner restricting member and rotated, toner is supplied to an image holding body by said toner layer, a toner image is formed onto said image holding body, the toner image is transferred onto a print medium, and an image is formed, comprising:

counting section which counts the toner image, on a dot unit basis, which is formed on the image holding body;

control section which changes a voltage that is applied to said developing roller when a count value of said counting section is equal to or larger than a predetermined reference value;

either temperature measuring section or moisture measuring section; and correcting section which corrects said reference value on the basis of information from said measuring section.

18. The image forming apparatus according to claim 17, wherein the toner restricting member has a bent tip and wherein a surface of the bent tip contacts the developing roller.

* * * * *